US006112929A

United States Patent [19]

Ota

[11] Patent Number: 6,112,929

[45] Date of Patent: Sep. 5, 2000

[54] COLLAPSIBLE CARGO CONTAINER AND METHOD OR USE

[76] Inventor: Hideyuki Ota, Tokyo, Japan

[21] Appl. No.: 09/245,650

[22] Filed: Feb. 8, 1999

Related U.S. Application Data

[60] Provisional application No. 60/114,442, Dec. 31, 1998.

[51] Int. Cl.[7] ..... B65D 88/20

[52] U.S. Cl. ..... 220/8; 220/1.5

[58] Field of Search ..... 220/8, 1.5, 666, 220/4.28, 4.33, 4.21; 206/586

[56] References Cited

U.S. PATENT DOCUMENTS

| | | | |
|---|---|---|---|
| 5,249,679 | 10/1993 | Dondlinger | 206/366 |
| 5,314,046 | 5/1994 | Pedrini | 190/105 |
| 5,370,256 | 12/1994 | Fourie et al. | 220/6 |
| 5,829,205 | 11/1998 | Clark et al. | 52/67 |
| 5,878,903 | 3/1999 | Ung | 220/8 |
| 5,890,612 | 4/1999 | Coppi | 220/7 |

FOREIGN PATENT DOCUMENTS

| | | | |
|---|---|---|---|
| 21757 | 8/1961 | Germany | 220/8 |

*Primary Examiner*—Stephen Castellano
*Attorney, Agent, or Firm*—Timothy Thut Tyson; Ted Masters; Freilich Hornbaker & Rosen

[57] ABSTRACT

A collapsible cargo container (20) includes a lower portion (22) which is surrounded and slidably received by an upper portion (44). Upper portion (44) may be raised and locked in a fully extended position wherein collapsible cargo container (20) has the dimensions and connection interfaces of a conventional cargo container. Alternatively, upper portion (44) may be lowered onto lower portion (22) so that the volume of collapsible container (20) is approximately one-half that of a convention cargo container. A plurality of connectors (70) hold the walls of the upper portion (44) and lower portion (22) together in either the fully extended or fully collapsed positions. Four hinged corner posts (36*a–d*) permit upper portion (44) to reside on lower portion (22) in either a fully extended or fully collapsed position.

12 Claims, 7 Drawing Sheets

48c
44
46
54
48b
62
50
72
48d
20
56
68
52
64
60
48a
77
36c
74
76
22
40
26c
24
68
42
36b
36d
26b
32
68
38
28
26d
34
30
36a
26a 48c
44
46
54
48b
62
50
72
48d
56
68
52
20
64
60
48a
36c
74
76
41
39
22
40
35
37
26c
24
68
42
36b
36d
26b
32
68
38
28
26d
34
30
36a
26a

COLLAPSIBLE CARGO CONTAINER AND METHOD OR USE

CROSS-REFERENCE TO RELATED APPLICATION

This application claims the filing benefit under 35 U.S.C. §119(e) of U.S. Provisional application Ser. No. 60/114,442, filed Dec. 31, 1998, which included herein by reference.

TECHNICAL FIELD

The present invention pertains in general to the transportation of cargo, and in particular to standardized cargo containers which are used throughout the international shipping industry.

BACKGROUND ART

Standard cargo containers are well known in the shipping art and are used throughout the world to transport goods by ship, rail, and truck. The containers comprise elongated box-like parallelepipedal structures. The dimensions of the containers are governed by International Standards Organization (ISO) specifications, and include an 8.5 foot height, an 8 foot width, and various lengths such as 20 feet and 40 feet. The eight corners of the containers have standard hollow corner blocks or castings which accept lifting and mounting connectors by which the container can be lifted or secured in place.

Cargo containers are most effectively utilized when they are fully loaded with goods during the shipping process. However, periodic worldwide economic conditions can occasion a shipping imbalance. For example, the 1997–1998 "Asian economic crisis" has resulted in thousands of containers traveling from Asia to the United States fill, and returning to the orient empty or "dead headed". On the return trip the empty containers both constitute wasted shipping volume, and since they are vertically stacked above decks, also present a wind-resisting surface which necessitates a slowing of the transport vessel. As much as two or three additional days can be added to a Pacific crossing. The wind-resistance problem is exacerbated by the fact that the empty containers cause the ship to ride higher in the water.

The present invention is directed to mitigating the above-mentioned problems by providing a vertically collapsible container. The collapsible feature results in a shorter container stack which presents less wind resistance. Alternatively, more containers can be stacked thereby lowering the ship in the water and reducing the wind-resistance problem.

Examples of existing collapsible cargo containers include U.S. Pat. No. 3,966,075 which illustrates a receivable cargo container which can be cooperatively arranged with a standard cargo container in order to reduce "dead heading" operations by as much as 50%. The receivable cargo container slides into the end of the standard cargo container. U.S. Pat. No. 4,177,907 comprises a collapsible shipping container having hinged walls which fold together, thereby reducing the volume of the container. U.S. Pat. No. 4,355,732 discloses a folding container wherein two ends fold onto a base. U.S. Pat. No. 4,360,115 depicts a sectional multipurpose cargo container which has provision for optional individual use or plural interlocked use. Two container halves are one-half the height of a normal container, and may be joined together to serve as a conventional container, or may be used separately to carry bulk raw materials. U.S. Pat. No. 5,370,256 includes a collapsible container. The height of the walls can be adjusted by sliding the sides. A lid is removably mounted to the walls. U.S. Pat. No. 5,111,950 comprises a shipping container which has a pallet base with four upstanding corner posts. A box-shaped cover is removed during the loading of cargo upon the pallet, and installed after the cargo is loaded. U.S. Pat. No. 5,170,901 shows a transportable construction element in the form of a container. The device has at least one hinged panel capable of pivoting between a closed position and an open position swung outwards, and an internal structure. U.S. Pat. No. 5,257,830 consists of a collapsible freight and storage container which has internal gears for lifting and lowering the top. Accordion style walls are utilized to accommodate the expanded and collapsed configurations. U.S. Pat. No. 5,501,333 discloses a collapsible container having a base, side wall and cap. When the container is collapsed, the cap can engage the base so that a container of reduced size is formed. The side walls are folded during the collapsing process. U.S. Pat. No. 5,611,449 illustrates a foldable container comprising a floor, a roof, and at least two side walls. Each of the side walls is connected with the floor through link members forming a connection between the edge side and the floor and the lower edge side of respective side walls.

DISCLOSURE OF INVENTION

The present invention is directed to a collapsible cargo container which achieves a substantial (near 50%) volume saving when the container is transported in a fully collapsed configuration. The present invention assists in overcoming the previously mentioned "imbalance" shipping problem which arises due to global or local economic conditions. The container consists of two parts or shells, an upper portion and a lower portion, which are slidably joined. The upper portion slides vertically up and down over the lower portion. The upper portion surrounds the lower portion so that rain cannot seeping into the joint between the two. In a fully extended position, the container is the same size as a conventional cargo container, and includes eight corner blocks which are arranged in standard ISO spaced relationship. In the fully collapsed position, the container is slightly more than one-half the size of a standard cargo container.

In a preferred embodiment, the collapsible container includes four hinged corner posts on the lower portion which abut the planar top of the upper portion. The four hinged upstanding corner posts rotate from a fully extended position to a fully collapsed position, thereby retaining the upper portion in a fully extended or fully collapsed position respectively. A plurality of horizontally spaced connectors connect the upper and lower portions in either the fully extended or fully collapsed positions. Four raising and lowering devices (such as jacks) can be installed between the four corners of the upper portion and the four corners of the lower portion to effect the extending and collapsing of the container. The principles of the present invention may be applied to newly constructed containers, or alternatively, existing containers may be modified to incorporated the features of the present invention.

In accordance with a preferred embodiment of the invention, a collapsible cargo container includes a lower portion including a substantially rectangular substantially planar base having four corners, a bottom surface, a first base side edge, an opposite second base side edge, and a base end edge disposed therebetween. Four upwardly projecting corner posts emanate from the four corners. A first base side panel is connected to the first base side edge and upwardly projects therefrom. A second base side panel is connected to the second base side edge and upwardly projects therefrom. A base end panel is connected to the base end edge and upwardly projects therefrom, with the base end panel being perpendicular to the first base side panel and the second base side panel, the three base panels forming a U-shaped base wall. An upper portion including a substantially rectangular substantially planar top having four corners, a top surface, a first top side edge, an opposite second top side edge, and a top end edge disposed therebetween. A first top side panel is connected to the first top side edge and downwardly projects therefrom. A second top side panel is connected to the second top side edge and downwardly projects therefrom. A top end panel is connected to the top end edge and downwardly projects therefrom, the top end panel being perpendicular to the first top side panel and the second top side panel, the three top panels forming a U-shaped top wall. The U-shaped top wall is dimensioned to vertically receive the U-shaped base wall. The upper portion is vertically positionable with respect to the lower portion from a fully extended position to a fully collapsed position.

In accordance with an important aspect of the invention, the four corner posts are hinged so that they can rotate from a fully extended position to a fully collapsed position.

In accordance with an important feature of the invention, the upper and lower portions are held together in either the fully extended position or the fully collapsed position by a plurality of horizontally-spaced connectors.

In accordance with another important aspect of the invention, stiffeners are connected to the upper and lower portions, and are connected by the connectors, thereby adding strength and rigidity to the container.

In accordance with another aspect of the invention, permanently installed raising and lowering devices are attached to the four corners to raise and lower the upper portion.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
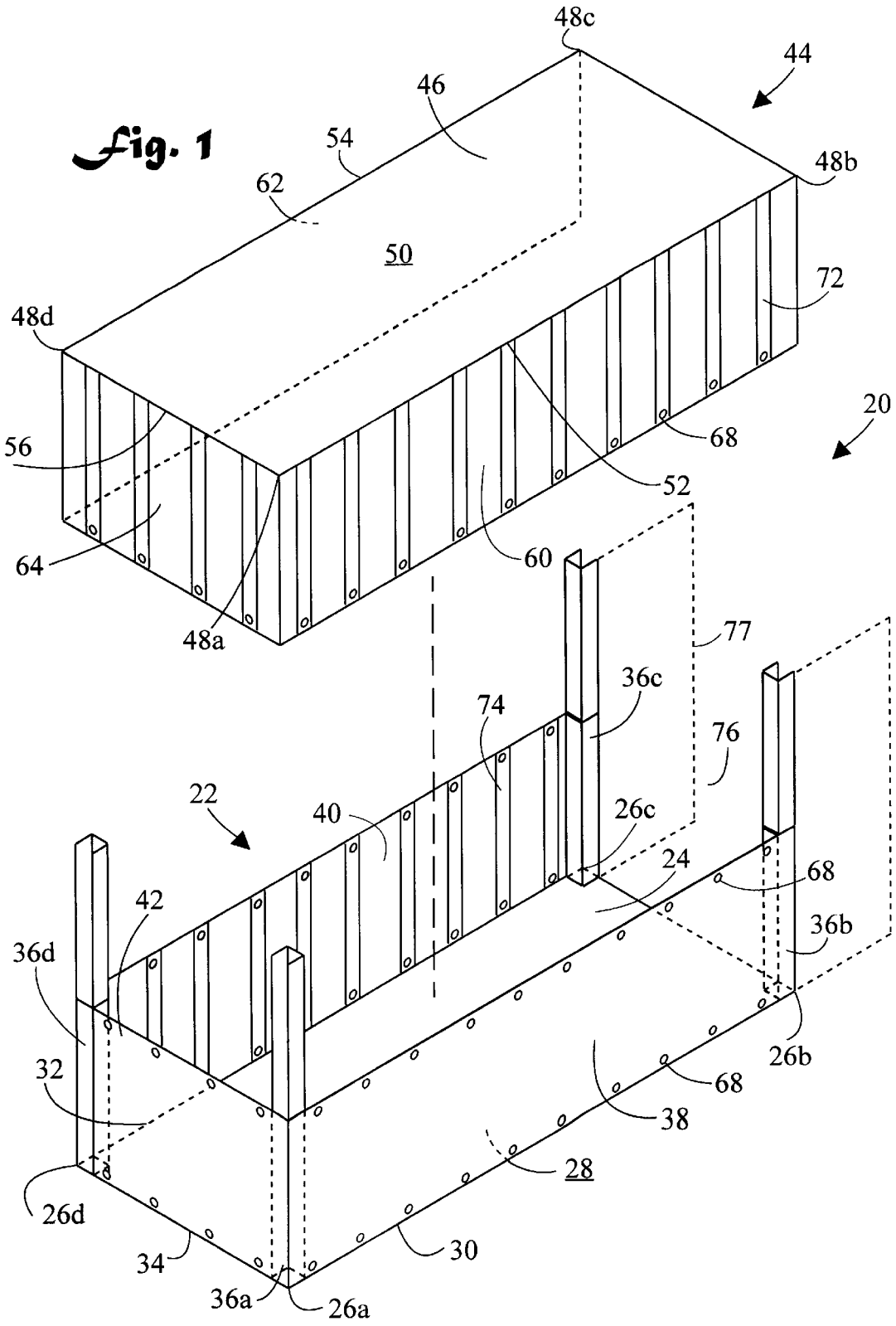
FIG. 1 is an exploded perspective view of a collapsible cargo container in accordance with the present invention.

Referring initially to FIG. 1, there is illustrated an exploded perspective view of a collapsible cargo container in accordance with the present invention, generally designated as 20. Collapsible cargo container 20 includes a lower portion 22 which has a substantially rectangular substantially planar base 24 having four corners 26*a–d,* a bottom surface 28, a first base side edge 30, an opposite second base side edge 32, and a base end edge 34 disposed between first base side edge 30 and second base side edge 32. Four upwardly projecting base corner posts 36*a–d* are connected at four corners 26*a–d,* and are substantially perpendicular to planar base 24. An upwardly projecting first base side panel 38 is connected to first base side edge 30 and also to base corner posts 36*a* and 36*b.* An upwardly projecting second base side panel 40 is connected to second base side edge 32 and also to base corner posts 36*c* and 36*d.* An upwardly projecting base end panel 42 is connected to said base end edge 34 and also to base corner posts 36*a* and 36*d.* Base end panel 42 is perpendicularly oriented to first base side panel 38 and second base side panel 40, the three base panels forming a upstanding U-shaped base wall.

Collapsible cargo container 20 also includes an upper portion 44 which has a substantially rectangular substantially planar top 46 having four corners 48*a–d,* a top surface 50, a first top side edge 52, an opposite second top side edge 54, and a top end edge 56 disposed between first top side edge 52 and second top side edge 54. A downwardly projecting first top side panel 60 is connected to first top side edge 52. A downwardly projecting second top side panel 62 is connected to second top side edge 54. A downwardly projecting top end panel 64 is connected to top end edge 56. Top end panel 64 is perpendicularly connected to first top side panel 60 and second top side panel 62, the three top panels forming a downwardly projecting U-shaped top wall. The U-shaped top wall is dimensioned to slidably receive the U-shaped base wall, so that the top wall may be slid up and down with respect to the base wall. That is, upper portion 44 is vertically positionable with respect to lower portion 22 from a fully extended position to a fully collapsed position. In order to accomplish this, the U-shaped base wall is inset slightly from edges 30, 32, and 34 of planar base 24, so that the U-shaped top wall of upper portion 44 fits around the U-shaped base wall of lower portion 22 (also refer to FIG. 5) Collapsible cargo container 20 also has an open end 76 opposite to top 64 and base 42 end panels. Two doors 77 are connected to open end 76.

Figure 2:
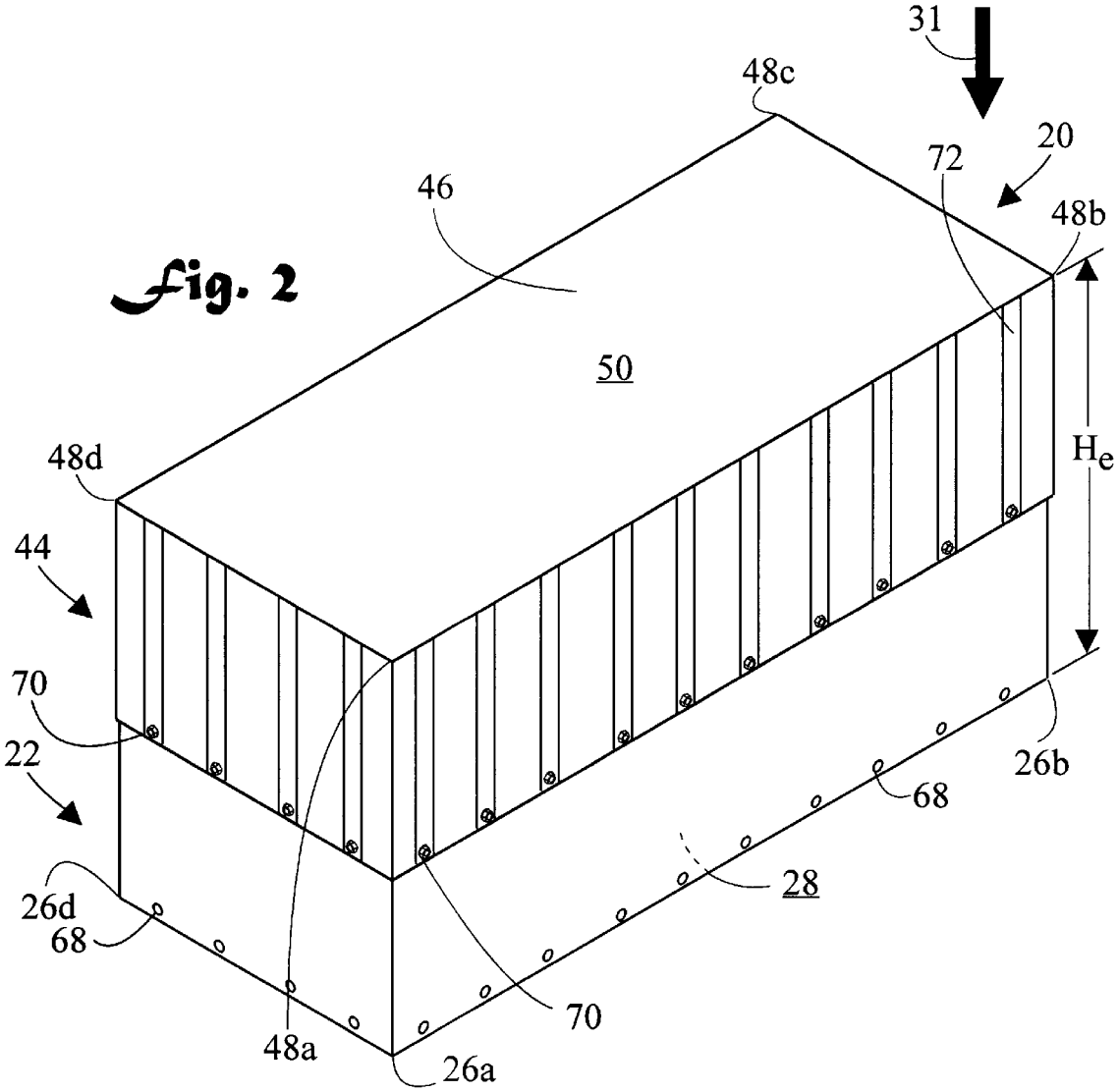
FIG. 2 is a perspective view of the collapsible cargo container in the fully extended position.

FIG. 2 is a perspective view of collapsible cargo container 20 in the fully extended position. Upper portion 44 has been lowered in direction 31 onto lower portion 22 so that four corner posts 36*a–d* abut planar top 46 with the upper portion 22 resting upon the four corner posts 36*a–d.* In this fully extended position, the distance He between top surface 50 and bottom surface 28 is about 8.5 ft as prescribed by ISO standards. Also, in the fully extended position, four top corners 48*a–d* and four base corners 26*a–d* are arranged in standard cargo industry spaced relationship.

Figure 3:
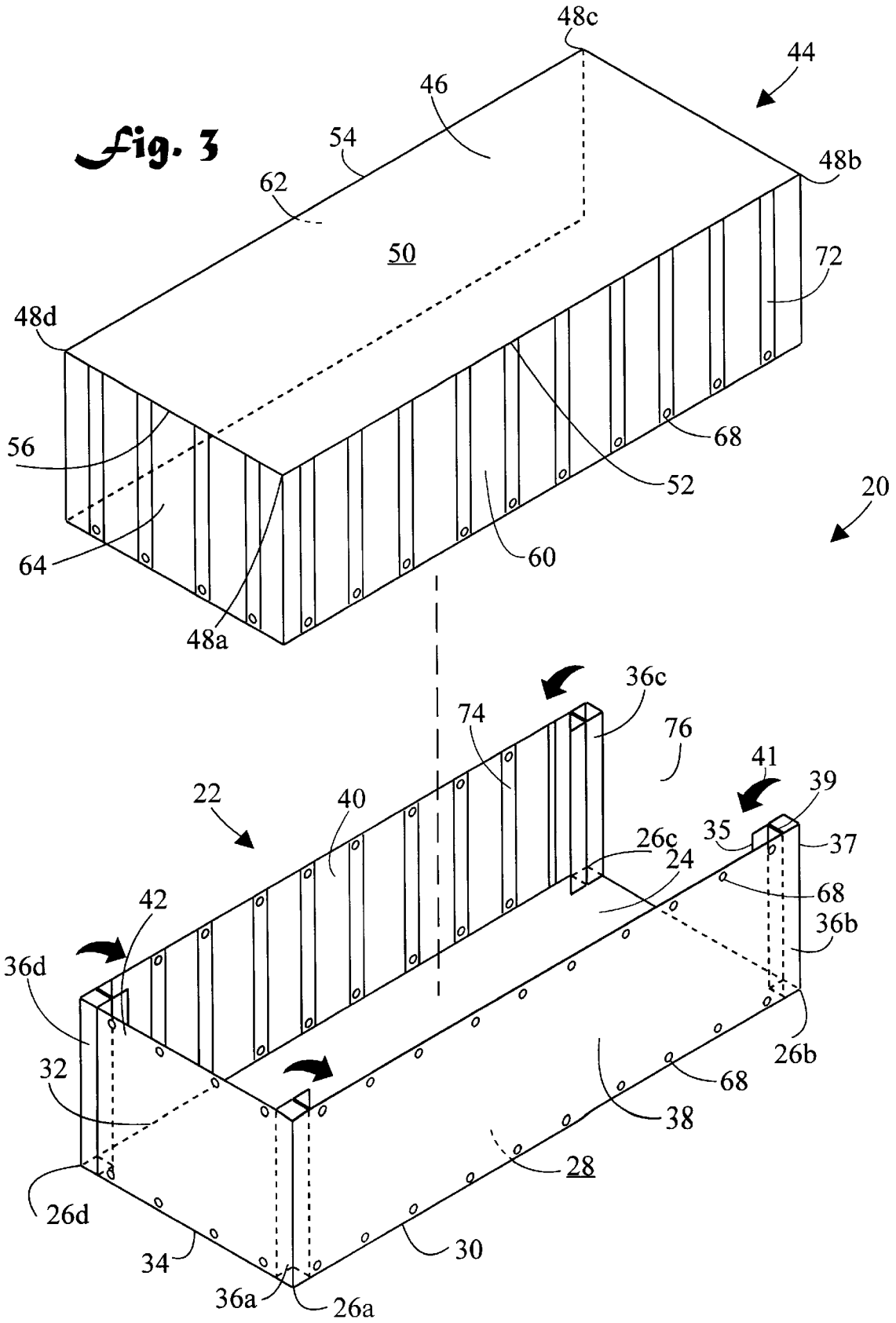
FIG. 3 is an exploded perspective view of the collapsible cargo container with the four hinged corner posts rotated downward.
Figures 6, 7, 8, 9, 10, 11:
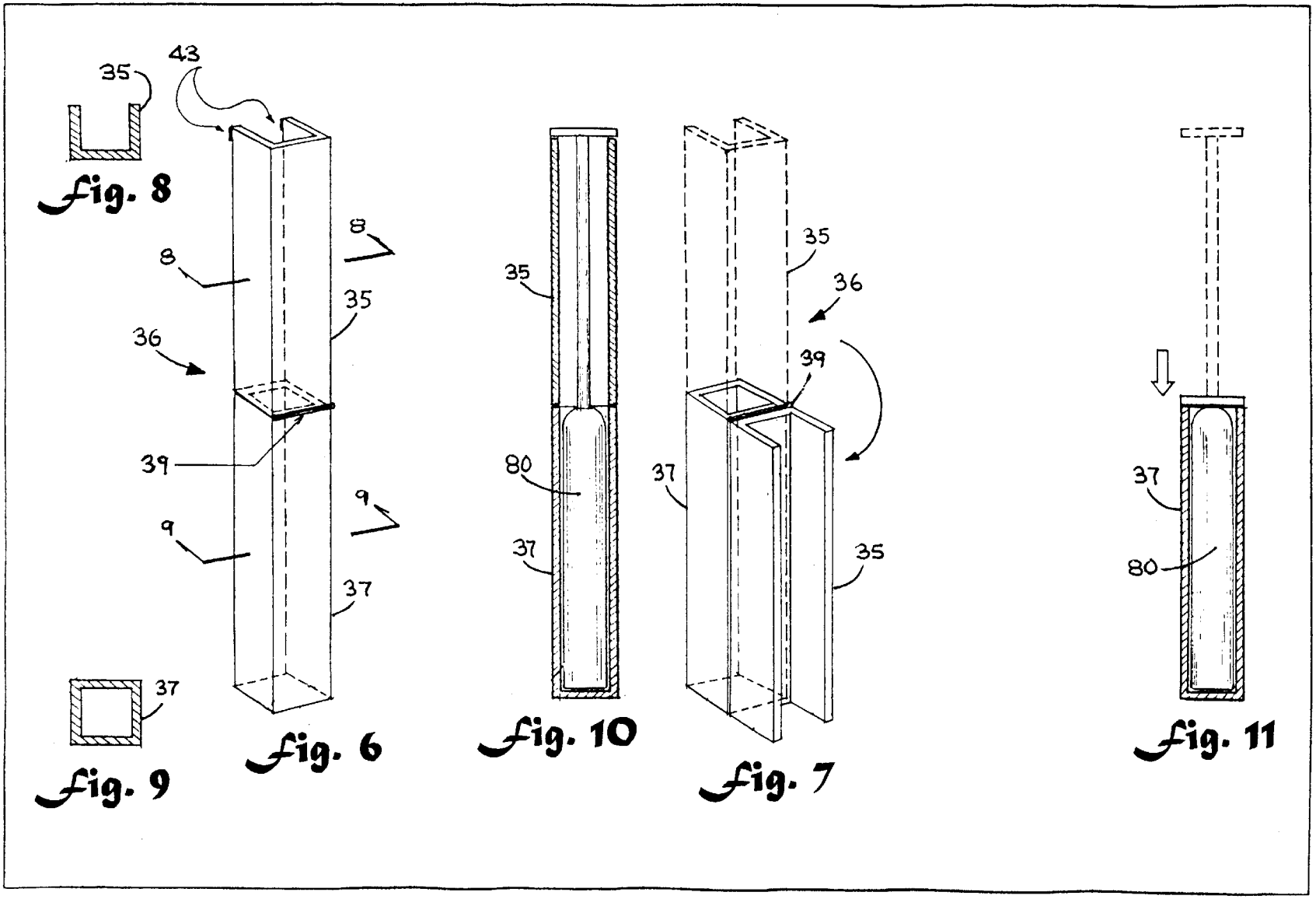
FIG. 6 is an enlarged perspective view of a hinged corner post in the fully extended position.
FIG. 7 is an enlarged perspective view of the hinged corner post rotated downward to the fully collapsed position.
FIG. 8 is a cross sectional view along the line 8—8 of FIG. 6.
FIG. 9 is a cross sectional view along the line 9—9 of FIG. 6.
FIG. 10 is an enlarged side elevation view of a raising and lowering device in the fully extended position.
FIG. 11 is an enlarged side elevation view of the raising and lowering device in the fully collapsed position.

FIG. 3 is an exploded perspective view of the collapsible cargo container 20 with four hinged corner posts 36*a–d* rotated downward (also refer to FIGS. 6 and 7). Four upwardly projecting corner posts 36*a–d* each have a top portion 35, a bottom portion 37 and a hinge 39 therebetween, so that the corner posts can be folded over substantially in half in direction 41. In a preferred embodiment, top portion 35 has a U-shaped cross section, and bottom portion 37 has a hollow square-shaped cross section. Four upwardly projecting corner posts 36*a–d* have an unfolded fully extended position (FIGS. 1 and 6) wherein collapsible cargo container 20 is in a fully extended position. Four upwardly projecting corner posts 36*a–d* having a folded fully collapsed position (FIGS. 3, 4, and 7) wherein collapsible cargo container 20 is in a fully collapsed position. Referring to FIG. 6, a lock 43 is provided for retaining four upwardly projecting corner posts 36*a–d* in the unfolded fully extended position. In a preferred embodiment, lock 43 comprises a magnet which holds the corner posts in the fully extended position.

Figure 4:
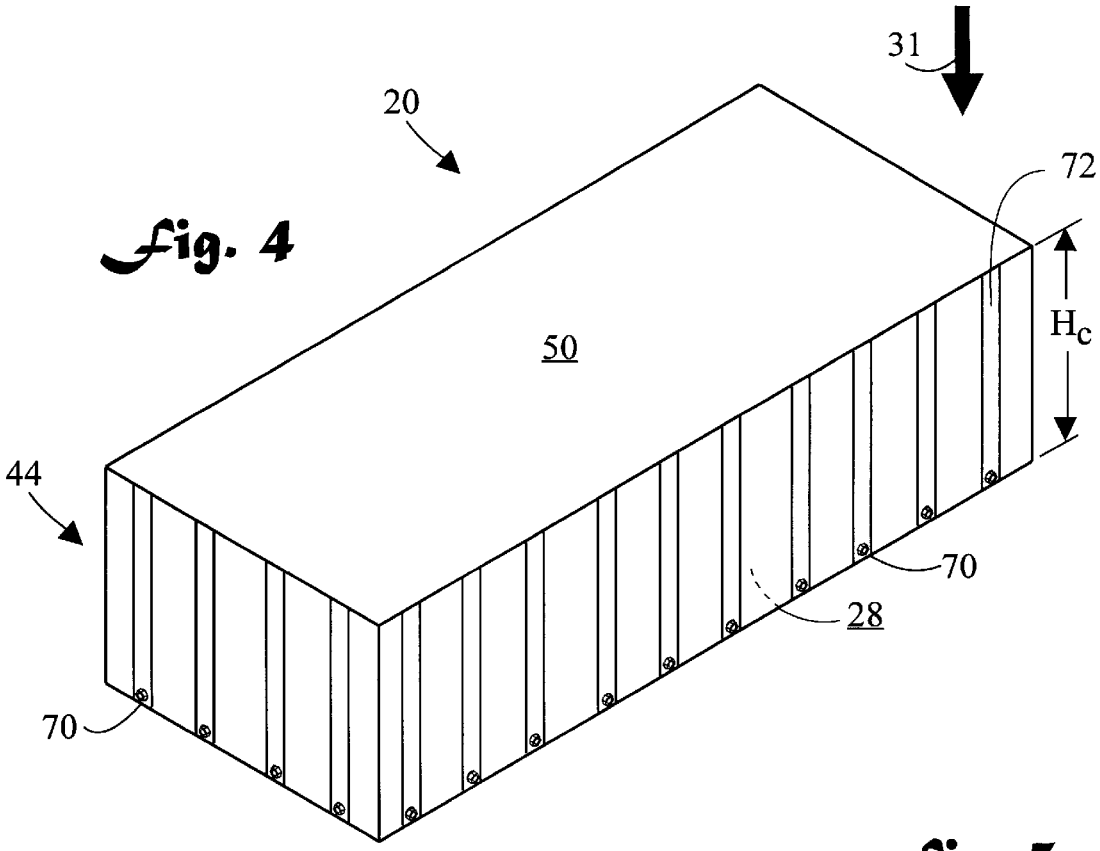
FIG. 4 is a perspective view of the collapsible cargo container in the fully collapsed position.

FIG. 4 is a perspective view of collapsible cargo container 20 in the fully collapsed position, wherein upper portion 44 has been lowered in direction 31 over lower portion 22. In the fully collapsed position, the distance $H_c$ between top surface 50 and bottom surface 28 is about between 4.25 ft and 5 ft.

Referring again to FIGS. 2 and 4, a plurality of horizontally-spaced connectors 70 connect U-shaped top wall to said U-shaped base. In FIG. 2, the plurality of horizontally-spaced connectors 70 connect the top wall to the base wall when upper portion 44 is in said fully extended position. In FIG. 4, the plurality of horizontally-spaced connectors 70 connect the top wall to the base wall when upper portion 44 is in the fully collapsed position. Referring also to FIG. 1, the plurality of horizontally-spaced connectors 70 including a plurality of aligned holes 68 in the top and base walls which receive a corresponding plurality of bolts and nuts. Upper portion 44 has one row of holes 68, and lower portion 22 has two spaced rows of holes 68. In a preferred embodiment, a first plurality of horizontally-spaced vertically-extending stiffeners 72 are disposed on the U-shaped top wall. And, a cooperating second plurality of horizontally-spaced vertically-extending stiffeners 74 are disposed on the U-shaped base wall. Spaced connectors 70 connect first 72 and second 74 plurality of horizontally-spaced vertically-extending stiffeners (also refer to FIGS. 12–16).

Figure 5:
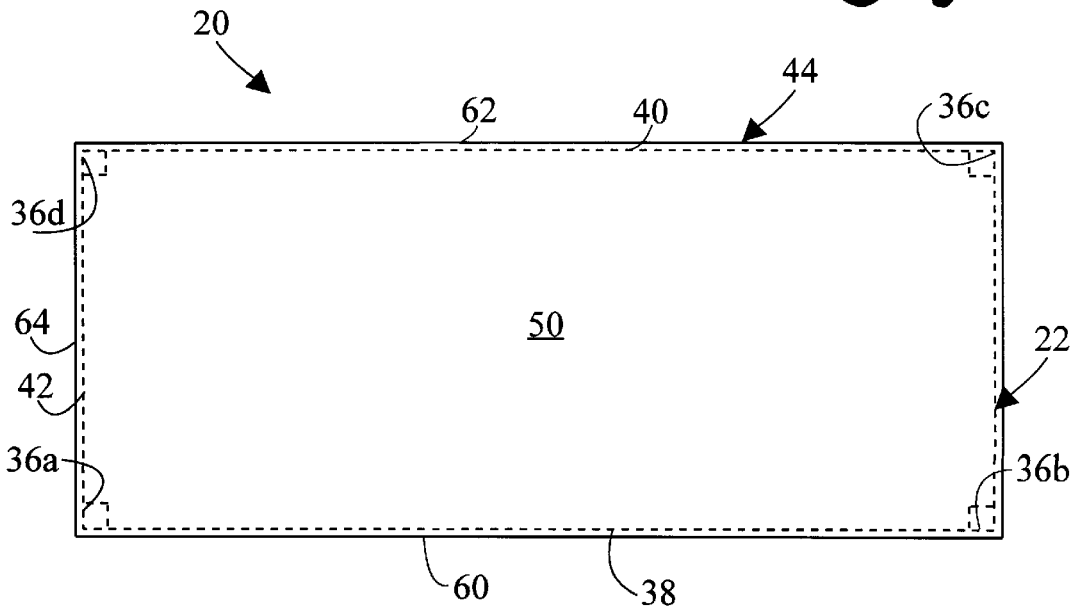
FIG. 5 is a top plan view of the collapsible cargo container.

FIG. 5 is a top plan view of collapsible cargo container 20 showing how top panels 60, 62, and 64 of upper portion 44 surround and slidably receive base panels 38, 40, and 42 of lower portion 22. It is noted that in FIGS. 1–4 in the interest of clarity, the conventional cargo container corner blocks have not been shown. The corner blocks are located at corners 26*a–d* (lower portion 22) and 48*a–d* (upper portion 22).

FIG. 6 is an enlarged perspective view of a hinged corner post 36 in the fully extended position, showing top portion 35, bottom portion 37, hinge 39, and lock 43.

FIG. 7 is an enlarged perspective view of hinged corner post 36 rotated downward to the fully collapsed position, wherein top portion 35 pivots around hinge 39.

FIG. 8 is a cross sectional view along the line 8—8 of FIG. 6, showing the U-shaped cross section of top portion 35.

FIG. 9 is a cross sectional view along the line 9—9 of FIG. 6, showing the hollow square-shaped cross section of bottom portion 37.

FIG. 10 is an enlarged side elevation view of a raising and lowering device 80 in the fully extended position. Four raising and lowering devices 80 are permanently connected between the four corners 26*a–d* of planar base 24, and the four corners 48*a–d* of planar top 46. Raising and lowering device 80 can be used to raise and lower upper portion 44, and can be either pneumatic, hydraulic, or electric. In the shown preferred embodiment, raising and lowering device 80 is disposed within bottom portion 37 of corner post 36. Alternatively, the raising and lowering devices can be eliminated, and an external crane or other lifting apparatus used to raise and lower the upper portion 44 of collapsible container 20.

FIG. 11 is an enlarged side elevation view of raising and lowering device 80 in the fully collapsed position.

Figure 12:
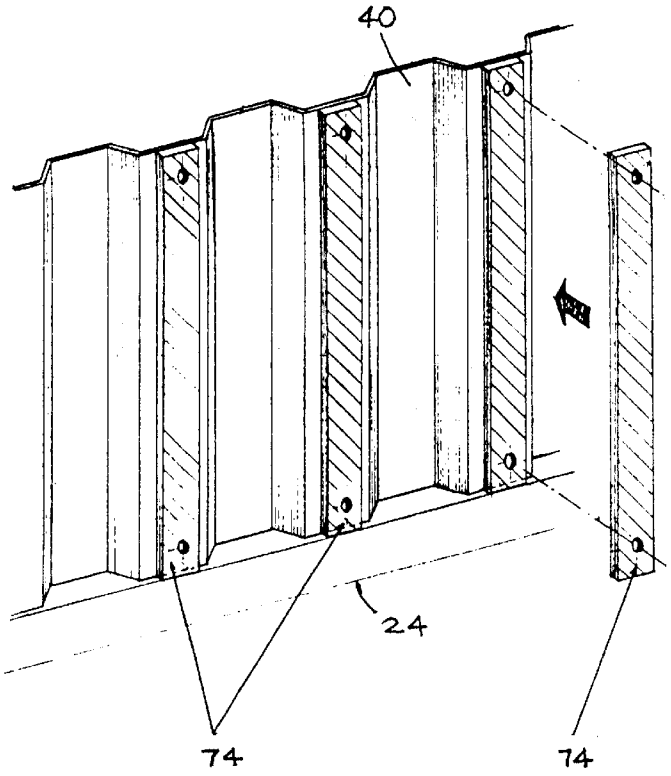
FIG. 12 is an enlarged perspective view of stiffeners attached to a side panel.

FIG. 12 is an enlarged perspective view of stiffeners 74 attached to second base side panel 40.

Figure 13:
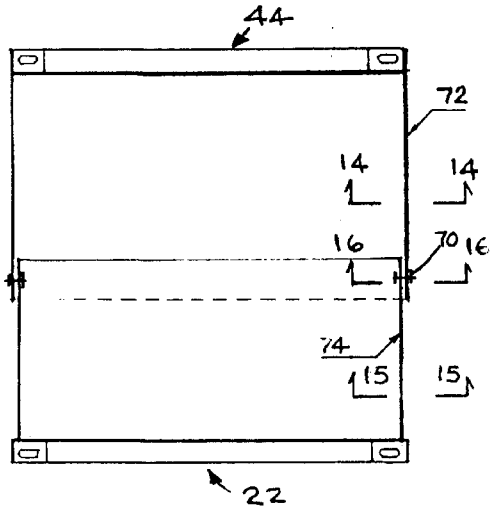
FIG. 13 is an end elevation view of the collapsible cargo container.

FIG. 13 is an end elevation view of the collapsible cargo container 20. Stiffeners 72 are disposed on the outside of upper portion 44, and stiffeners 74 are disposed on the inside of lower portion 22. Connector 70 connects stiffeners 72 and 74 thereby providing strength and rigidity to collapsible cargo container 20.

Figure 14:
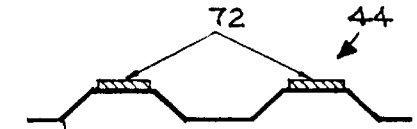
FIG. 14 is a cross sectional view along the line 14—14 of FIG. 13.

FIG. 14 is a cross sectional view along the line 14—14 of FIG. 13, showing stiffeners 72 disposed on the outside walls of upper portion 44.

Figure 15:
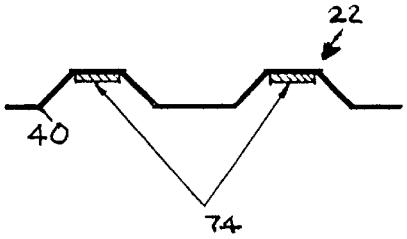
FIG. 15 is a cross sectional view along the line 15—15 of FIG. 13; and, FIG. 16 is a cross sectional view along the line 16—16 of FIG. 13.

FIG. 15 is a cross sectional view along the line 15—15 of FIG. 13, showing stiffeners 74 disposed on the inside walls of lower portion 22.

Figure 16:
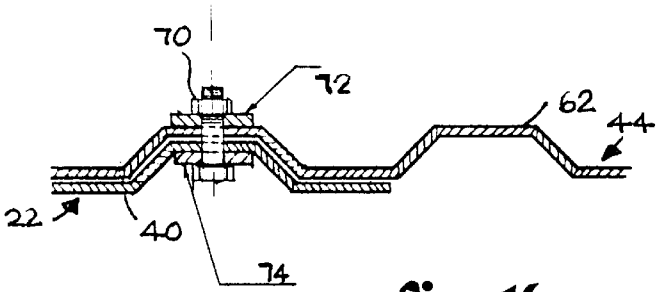

FIG. 16 is a cross sectional view along the line 16—16 of FIG. 13, showing stiffeners 72 connected to stiffeners 74 by connectors 70. In a preferred embodiment, a seal 82 is installed between the top wall and the base wall, and is secured in place by connectors 70. Seal 82 ensures that container 20 is watertight.

In terms of use, the height of collapsible cargo container 20 may be changed as follows:

disconnecting the upper portion 44 from the lower portion 22;

vertically raising the upper portion 44;

folding the upwardly projecting corner posts 36*a–d* substantially in half;

vertically lowering the upper portion 44 onto the lower portion 22; and, using connectors 70 to connect the upper 44 and lower 22 portions in the fully collapsed position.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A collapsible cargo container, comprising:

a lower portion including a substantially rectangular substantially planar base having four corners, a bottom surface, a first base side edge, an opposite second base side edge, and a base end edge disposed therebetween;

four upwardly projecting corner posts connected at said four corners;

a first base side panel connected to said first base side edge and upwardly projecting therefrom;

a second base side panel connected to said second base side edge and upwardly projecting therefrom;

an base end panel connected to said base end edge and upwardly projecting therefrom, said base end panel perpendicular to said first base side panel and said second base side panel, said three base panels forming a U-shaped base wall;

an upper portion including a substantially rectangular substantially planar top having four corners, a top surface, a first top side edge, an opposite second top side edge, and a top end edge disposed therebetween;

a first top side panel connected to said first top side edge and downwardly projecting therefrom;

a second top side panel connected to said second top side edge and downwardly projecting therefrom;

a top end panel connected to said top end edge and downwardly projecting therefrom, said top end panel perpendicular to said first top side panel and said second top side panel, said three top panels forming a U-shaped top wall;

said U-shaped top wall dimensioned to slidably receive said U-shaped base wall;

said upper portion vertically positionable with respect to said lower portion from a fully extended position to a fully collapsed position;

said four upwardly projecting corner posts abutting said planar top; and, said four upwardly projecting corner posts having a top portion, a bottom portion and a hinge therebetween, so that said four upwardly projecting corner posts can be folded substantially in half.

2. A collapsible cargo container according to claim 1, further including:

said top portion having a U-shaped cross section; and, said bottom portion having a hollow square-shaped cross section.

3. A collapsible cargo container according to claim 1, further including:

said four upwardly projecting corner posts having an unfolded fully extended position, wherein said collapsible cargo container is in a fully extended position; and, said four upwardly projecting corner posts having a folded fully collapsed position, wherein said collapsible cargo container is in a fully collapsed position.

4. A collapsible cargo container according to claim 3, further including:

a lock for retaining said four upwardly projecting corner posts in said unfolded fully extended position.

5. A collapsible cargo container comprising:

a lower portion including a substantially rectangular substantially planar base having four corners, a bottom surface a first base side edge, an opposite second base side edge, and a base end edge disposed therebetween;

four upwardly projecting corner posts connected at said four corners;

a first base side panel connected to said first base side edge and upwardly projecting therefrom;

a second base side panel connected to said second base side edge and upwardly projecting therefrom;

an base end panel connected to said base end edge and upwardly projecting therefrom, said base end panel perpendicular to said first base side panel and said second base side panel, said three base panels forming a U-shaped base wall;

an upper portion including a substantially rectangular substantially planar top having four corners, a top surface, a first top side edge, an opposite second top side edge, and a top end edge disposed therebetween;

a first top side panel connected to said first top side edge and downwardly projecting therefrom;

a second top side panel connected to said second top side edge and downwardly projecting therefrom;

a top end panel connected to said top end edge and downwardly projecting therefrom, said top end panel perpendicular to said first top side panel and said second top side panel, said three top panels forming a U-shaped top wall;

said U-shaped top wall dimensioned to slidably receive said U-shaped base wall;

said upper portion vertically positionable with respect to said lower portion from a fully extended position to a fully collapsed position;

a plurality of horizontally-spaced connectors connecting said U-shaped top wall to said U-shaped base wall;

said plurality of horizontally-spaced connectors including a plurality of aligned holes in said top and base walls which receive a corresponding plurality of bolts and nuts;

said upper portion having one row of said holes; and, said lower portion having two spaced rows of said holes.

6. A collapsible cargo container comprising:

a lower portion including a substantially rectangular substantially planar base having four corners, a bottom surface, a first base side edge, an opposite second base side edge, and a base end edge disposed therebetween;

four upwardly projecting corner posts connected at said four corners;

a first base side panel connected to said first base side edge and upwardly projecting therefrom;

a second base side panel connected to said second base side edge and upwardly projecting therefrom;

an base end panel connected to said base end edge and upwardly projecting therefrom, said base end panel perpendicular to said first base side panel and said second base side panel, said three base panels forming a U-shaped base wall;

an upper portion including a substantially rectangular substantially planar top having four corners, a top surface, a first top side edge, an opposite second top side edge, and a top end edge disposed therebetween;

a first top side panel connected to said first top side edge and downwardly projecting therefrom;

a second top side panel connected to said second top side edge and downwardly projecting therefrom;

a top end panel connected to said top end edge and downwardly projecting therefrom said top end panel perpendicular to said first top side panel and said second top side panel, said three top panels forming a U-shaped top wall;

said U-shaped top wall dimensioned to slidably receive said U-shaped base wall;

said upper portion vertically positionable with respect to said lower portion from a fully extended position to a fully collapsed position;

a plurality of horizontally-spaced connectors connecting said U-shaped top wall to said U-shaped base wall;

a seal installed between said top wall and said base wall; and, said seal secured in place by said plurality of horizontally-spaced connectors.

7. A collapsible cargo container, comprising:

a lower portion including a substantially rectangular substantially planar base having four corners, a bottom surface, a first base side edge, an opposite second base side edge, and a base end edge disposed therebetween;

four upwardly projecting corner posts connected at said four corners;

a first base side panel connected to said first base side edge and upwardly projecting therefrom;

a second base side panel connected to said second base side edge and upwardly projecting therefrom;

an base end panel connected to said base end edge and upwardly projecting therefrom, said base end panel perpendicular to said first base side panel and said second base side panel, said three base panels forming a U-shaped base wall;

an upper portion including a substantially rectangular substantially planar top having four corners, a top surface a first top side edge an opposite second top side edge and a top end edge disposed therebetween;

a first top side panel connected to said first top side edge and downwardly projecting therefrom;

a second top side panel connected to said second top side edge and downwardly projecting therefrom;

a top end panel connected to said top end edge and downwardly projecting therefrom, said top end panel perpendicular to said first top side panel and said second top side panel, said three top panels forming a U-shaped top wall;

said U-shaped top wall dimensioned to slidably receive said U-shaped base wall;

said upper portion vertically positionable with respect to said lower portion from a fully extended position to a fully collapsed position;

four raising and lowering devices connected between said four corners of said planar base and said four corners of said planar top; and, said four raising and lowering devices including one of hydraulic and electrical jacks.

8. A collapsible cargo container, comprising:

a lower portion including a substantially rectangular substantially planar base having four corners, a bottom surface, a first base side edge, an opposite second base side edge, and a base end edge disposed therebetween;

four upwardly projecting corner posts connected at said four corners;

first base side panel connected to said first base side edge and upwardly projecting therefrom;

a second base side panel connected to said second base side edge and upwardly projecting therefrom;

an base end panel connected to said base end edge and upwardly projecting therefrom, said base end panel perpendicular to said first base side panel and said second base side panel, said three base panels forming a U-shaped base wall;

an upper portion including a substantially rectangular substantially planar top having four corners, a top surface, a first top side edge, an opposite second top side edge, and a top end edge disposed therebetween;

a first top side panel connected to said first top side edge and downwardly projecting therefrom;

a second top side panel connected to said second top side edge and downwardly projecting therefrom;

a top end panel connected to said top end edge and downwardly projecting therefrom, said top end panel perpendicular to said first top side panel and said second top side panel, said three top panels forming a U-shaped top wall;

said U-shaped top wall dimensioned to slidably receive said U-shaped base wall;

said upper portion vertically positionable with respect to said lower portion from a fully extended position to a fully collapsed position;

an open end opposite to said top and base end panels; and two doors removably connected to said open end.

9. A collapsible cargo container, comprising:

a lower portion including a substantially rectangular substantially planar base having four corners a bottom surface, a first base side edge, an opposite second base side edge, and a base end edge disposed therebetween;

four upwardly projecting corner posts connected at said four corners;

a first base side panel connected to said first base side edge and upwardly projecting therefrom;

a second base side panel connected to said second base side edge and upwardly projecting therefrom;

an base end panel connected to said base end edge and upwardly projecting therefrom, said base end panel perpendicular to said first base side panel and said second base side panel, said three base panels forming a U-shaped base wall;

an upper portion including a substantially rectangular substantially planar top having four corners a top surface, a first top side edge, an opposite second top side edge, and a top end edge disposed therebetween;

a first top side panel connected to said first top side edge and downwardly projecting therefrom;

a second top side panel connected to said second top side edge and downwardly projecting therefrom;

a top end panel connected to said top end edge and downwardly projecting therefrom, said top end panel perpendicular to said first top side panel and said second top side panel, said three top panels forming a U-shaped top wall;

said U-shaped top wall dimensioned to slidably receive said U-shaped base wall;

said upper portion vertically positionable with respect to said lower portion from a fully extended position to a fully collapsed position;

said four upwardly projecting corner posts abutting said planar top;

said four upwardly projecting corner posts having a top portion, a bottom portion and a hinge therebetween, so that said four upwardly projecting corner posts my be folded substantially in half;

said four upwardly projecting corner posts having an unfolded fully extended position, wherein said collapsible cargo container is in a fully extended position;

said four upwardly projecting corner posts having a folded fully collapsed position, wherein said collapsible cargo container is in a fully collapsed position;

a plurality of horizontally-spaced connectors connecting said U-shaped top wall to said U-shaped base wall;

a first plurality of horizontally-spaced vertically-extending stiffeners disposed on said U-shaped top wall;

a cooperating second plurality of horizontally-spaced vertically-extending stiffeners disposed on said U-shaped base wall;

said plurality of horizontally-spaced connectors connecting said first and second plurality of horizontally-spaced vertically-extending stiffeners; and, when in said fully extended position, said four top corners and said four base corners arranged in standard cargo industry spaced relationship.

10. A method of changing the height of a collapsible cargo container, comprising:

providing a fully extended collapsible cargo container as recited in claim 1;

disconnecting said upper portion from said lower portion;

vertically raising said upper portion;

folding said upwardly projecting corner posts substantially in half;

vertically lowering said upper portion onto said lower portion; and, using connectors to connect said upper portion and said lower portion in the fully collapsed position.

11. The method according to claim 10, further including:

providing a first plurality of horizontally-spaced vertically-extending stiffeners disposed on said U-shaped top wall;

providing a cooperating second plurality of horizontally-spaced vertically-extending stiffeners disposed on said U-shaped base wall; and, using said plurality of horizontally-spaced connectors to connect said first and second plurality of horizontally-spaced vertically-extending stiffeners.

12. A collapsible cargo container, comprising:

a lower portion having an upstanding U-shaped base wall;

an upper portion having a downwardly projecting U-shaped top wall;

said U-shaped top wall dimensioned to slidably receive said U-shaped base wall;

a plurality of horizontally-spaced connectors connecting said U-shaped base wall to said U-shaped top wall in either a fully extended position or a fully collapsed position; and, said lower portion having four foldable upwardly projecting corner posts.

* * * * *